US011264704B2

(12) United States Patent
Li et al.

(10) Patent No.: US 11,264,704 B2
(45) Date of Patent: Mar. 1, 2022

(54) BASE STATION ANTENNA

(71) Applicant: AAC Technologies Pte. Ltd., Singapore (SG)

(72) Inventors: Lulong Li, Shenzhen (CN); Hua Jiang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 71 days.

(21) Appl. No.: 16/993,296

(22) Filed: Aug. 14, 2020

(65) Prior Publication Data

US 2020/0411964 A1 Dec. 31, 2020

Related U.S. Application Data

(63) Continuation of application No. PCT/CN2019/094039, filed on Jun. 30, 2019.

(51) Int. Cl.
*H01Q 1/24* (2006.01)
*H01Q 5/357* (2015.01)
*H01Q 5/28* (2015.01)

(52) U.S. Cl.
CPC ..... *H01Q 1/246* (2013.01); *H01Q 5/28* (2015.01); *H01Q 5/357* (2015.01)

(58) Field of Classification Search
CPC ..... H01Q 1/246; H01Q 5/28; H01P 5/12
USPC ..... 333/128
See application file for complete search history.

(56) References Cited

U.S. PATENT DOCUMENTS 10,522,922 B2 * 12/2019 Liu ..... H01Q 21/293
2020/0335881 A1 * 10/2020 Le ..... H01Q 1/521

FOREIGN PATENT DOCUMENTS

CN 107230827 A * 10/2017

* cited by examiner

*Primary Examiner* — Andrea Lindgren Baltzell
*Assistant Examiner* — Amal Patel
(74) *Attorney, Agent, or Firm* — W&G Law Group

(57) ABSTRACT

A base station antenna is provided, including at least two antenna sub-arrays. Each antenna sub-array includes a circuit board and two antenna oscillators. The circuit board includes a circuit substrate, and a first and second power divider disposed on a surface of the circuit substrate. The first and second power divider include a first, second and third end. Each antenna oscillator includes two pairs of first and second oscillator units of which polarizations are orthogonal. The second and third end of the first power divider are respectively electrically connected to the first oscillator unit of a first and second antenna oscillator. The second and third end of the second power divider is respectively electrically connected to the second oscillator unit of the first and second antenna oscillator. Two antenna oscillators form a 4T4R transceiving mode. The base station antenna of the present disclosure has the advantage of simple feeding mode.

10 Claims, 14 Drawing Sheets

BASE STATION ANTENNA

TECHNICAL FIELD

The present disclosure relates to the field of communication technology, in particular to a base station antenna.

BACKGROUND

The fifth-generation mobile communication technology will greatly change people's existing lifestyles and promote the continuous development of society. In order to adapt to the technical characteristics of high-speed, low-latency, high-capacity of future 5G, a base station antenna will also adopt large-scale array antennas more, and therefore higher requirements for antenna oscillators are also proposed. A feeding manner of an antenna sub-array included in the existing base station antenna is complicated, which is unfavorable to the miniaturization of the base station antenna.

Therefore, it is necessary to provide a base station antenna with a simple feeding manner to solve the above problems.

SUMMARY

The present disclosure intends to provide a base station antenna with a simple feeding manner.

The technical solution of the present disclosure is as follows. The present disclosure provides a base station antenna; the base station antenna includes at least two antenna sub-arrays, each of the antenna sub-arrays includes a circuit board and two antenna oscillators; the circuit board includes a circuit substrate, and a first power divider and a second power divider that are disposed on a surface of the circuit substrate; the first power divider and the second power divider are respectively used to divide one signal into two signals, and the first power divider and the second power divider comprise a first end, a second end and a third end; each of the antenna oscillators includes two pairs of first oscillator units and second oscillator units of which polarizations are orthogonal; the first end of the first power divider is used to connect a radio frequency front end, the second end of the first power divider is electrically connected to the first oscillator unit of a first antenna oscillator, and the third end of the first power divider is electrically connected to the first oscillator unit of a second antenna oscillator; the first end of the second power divider is used to connect the radio frequency front end, the second end of the second power divider is electrically connected to the second oscillator unit of the first antenna oscillator, and the third end of the second power divider is electrically connected to the second oscillator unit of the second antenna oscillator; and two antenna sub-arrays form a 4T4R transceiving mode.

As an improvement, the first power divider and the second power divider include a first connection line, a second connection line and a third connection line; the second connection line and the third connection line are electrically connected to the first connection line respectively; one end of the first connection line away from the second connection line is a first end, one end of the second connection line away from the first connection line is a second end, and one end of the third connection line away from the first connection line is a third end.

As an improvement, the first power divider and the second power divider are disposed on the same surface of the circuit substrate; the circuit board further includes a ground plate disposed on a surface of the circuit substrate opposite to the first power divider, and the ground plate is electrically connected to the first oscillator unit and the second oscillator unit of each of the antenna oscillators respectively.

As an improvement, the first oscillator unit includes a first radiating portion; the first radiating portion includes a radiating substrate, and a first radiator and a second radiator that are disposed on a surface of the radiating substrate, and the first radiator and the second radiator are disposed separately from and symmetrically with each other.

The second oscillator unit includes a second radiating portion; the second radiating portion includes the radiating substrate shared with the first radiating portion, and a third radiator and a fourth radiator that are disposed on the surface of the radiating substrate; the third radiator and the fourth radiator are disposed separately from and symmetrically with each other; a straight line where a geometric center of the first radiator and a geometric center of the second radiator are located is perpendicular to a straight line where a geometric center of the third radiator and a geometric center of the fourth radiator are located.

As an improvement, the first radiator, the second radiator, the third radiator and the fourth radiator have the same structure and comprise a sector portion with a central angle of 90°, two extension portions extending from two radii of the sector portion in a direction away from a center of the sector portion, and an L-shaped connection portion connecting the two extension portions; and an outer contour of the radiators is square.

As an improvement, a corner of the L-shaped connection portion is adjacent to a center of the radiating substrate; the first radiator, the second radiator, the third radiator and the fourth radiator form a square; the first radiator, the second radiator, the third radiator and the fourth radiator are respectively located at four corners of the square; and circles of four sector portions of the first radiator, the second radiator, the third radiator and the fourth radiator are respectively located at the four corners of the square.

As an improvement, an inner corner of the L-shaped connection portion is a smooth transition.

As an improvement, the first oscillator unit further includes a first feeding portion for feeding the first radiating portion.

The first feeding portion includes a first feeding substrate, a first ground disposed on one side surface of the first feeding substrate, and a first microstrip line disposed on the other side surface of the first feeding substrate; the first microstrip line of the first antenna oscillator is electrically connected to the second end of the first power divider, and the first microstrip line of the second antenna oscillator is electrically connected to the third end of the first power divider.

One end of the first feeding substrate is perpendicular to and connected to the radiating substrate, and the other end of the first feeding substrate is perpendicular to and connected to the circuit substrate; the first ground is connected to the first radiator and the second radiator respectively, and the first microstrip line is separated from and coupled to the first radiator and the second radiator respectively.

The second oscillator unit further includes a second feeding portion for feeding the second radiating portion.

The second feeding portion includes a second feeding substrate, a second ground disposed on one side surface of the second feeding substrate, and a second microstrip line disposed on the other side surface of the second feeding substrate; the second microstrip line of the first antenna oscillator is electrically connected to the second end of the second power divider, and the second microstrip line of the second antenna oscillator is electrically connected to the third end of the second power divider.

One end of the second feeding substrate is perpendicular to and connected to the radiating substrate, and the other end of the second feeding substrate is perpendicular to and connected to the circuit substrate; the second ground is connected to the third radiator and the fourth radiator, and the second microstrip line is separated from and coupled to the third radiator and the fourth radiator respectively.

As an improvement, the first radiator, the second radiator, the third radiator and the fourth radiator are located on the same surface of the radiating substrate.

The first radiator and the second radiator are symmetrical to each other about a first symmetry line, and the third radiator and the fourth radiator are symmetrical to each other about a second symmetry line; the first symmetry line is perpendicular to the second symmetry line, each radiator of the first oscillator unit is axisymmetric about the second symmetry line, and each radiator of the second oscillator unit is axisymmetric about the first symmetry line.

As an improvement, the first feeding substrate is respectively engaged with the radiating substrate and the circuit substrate, and the second feeding substrate is respectively engaged with the radiating substrate and the circuit substrate.

Compared with the existing technology, in the embodiments of the present disclosure, the third end of the first power divider is electrically connected to the first oscillator unit of the second antenna oscillator, the first end of the second power divider is used to connect the radio frequency front end, the second end of the second power divider is electrically connected to the second oscillator unit of the first antenna oscillator, and the third end of the second power divider is electrically connected to the second oscillator unit of the second antenna oscillator. A manner for feeding the oscillator unit is simple, which is favorable to the miniaturization of the base station antenna, and the antenna oscillator achieves orthogonal polarization.

DETAILED DESCRIPTION

In order to make objectives, technical solutions and advantages of the present disclosure clearer, the present disclosure will be explained below in detail with reference to the accompanying drawings and embodiments. It should be understood that the specific embodiments described here are only used to explain but not to limit the present disclosure. Based on the embodiments of the present disclosure, all other embodiments obtained by those of ordinary skills in the art without making inventive efforts fall within the protection scope of the present disclosure.

The terms "first", "second", "third", "fourth", etc. (if any) in the description, claims and the above drawings of the present disclosure are used to distinguish similar objects without being used to describe a specific order or sequence. It should be understood that the data used in this way may be interchanged under appropriate circumstances so that the embodiments described herein may be implemented in an order other than what is illustrated or described herein. In addition, the terms "including" and "having" and any variations thereof are intended to cover non-exclusive inclusions, for example, the processes, methods, systems, products or devices that include a series of steps or units need not be limited to those steps or units clearly listed but may include other steps or units that are not explicitly listed or inherent to these processes, methods, products or devices.

It should be noted that the descriptions related to "first", "second", etc. in the present disclosure are only for the purpose of description, and may not be understood as indicating or implying their relative importance or implicitly indicating the number of technical features indicated. Thus, the features defined as "first" and "second" may include at least one of the features either explicitly or implicitly. In addition, the technical solutions between the various embodiments can be combined with each other, but they must be based on the premise that those of ordinary skills in the art are able to achieve. When the combination of technical solutions conflicts with each other or may not be realized, it should be considered that the combination of such technical solutions does not exist and is not within the protection scope claimed by the present disclosure.

Figure 1:
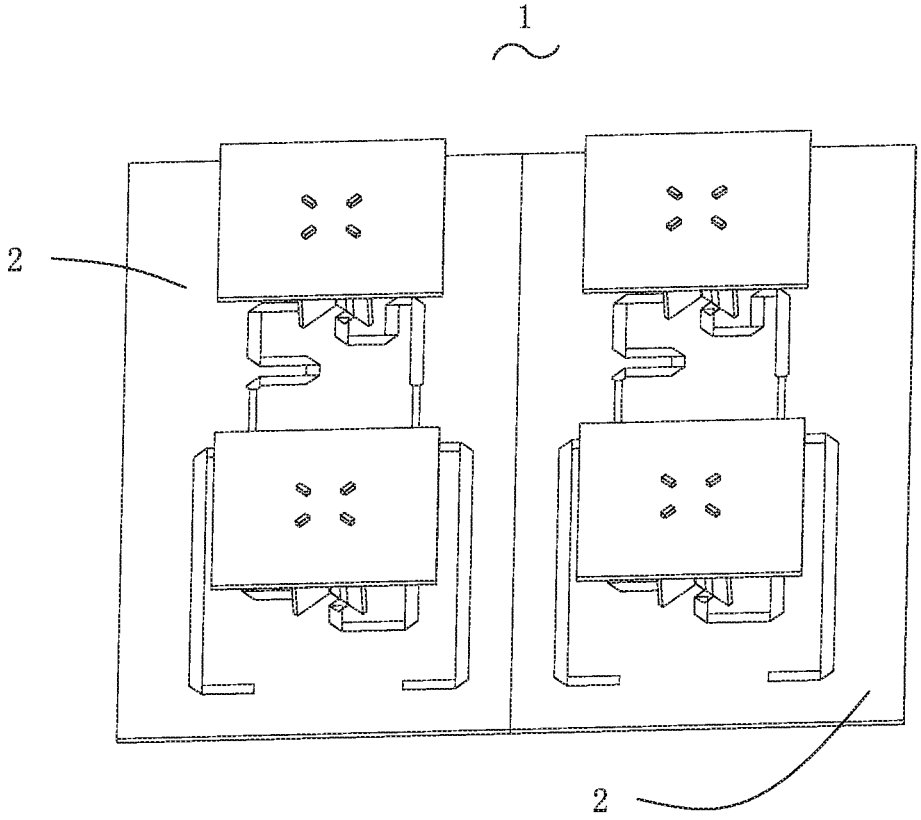
FIG. 1 is a schematic diagram of a three-dimensional structure of a base station antenna provided in an embodiment of the present disclosure.
Figure 2:
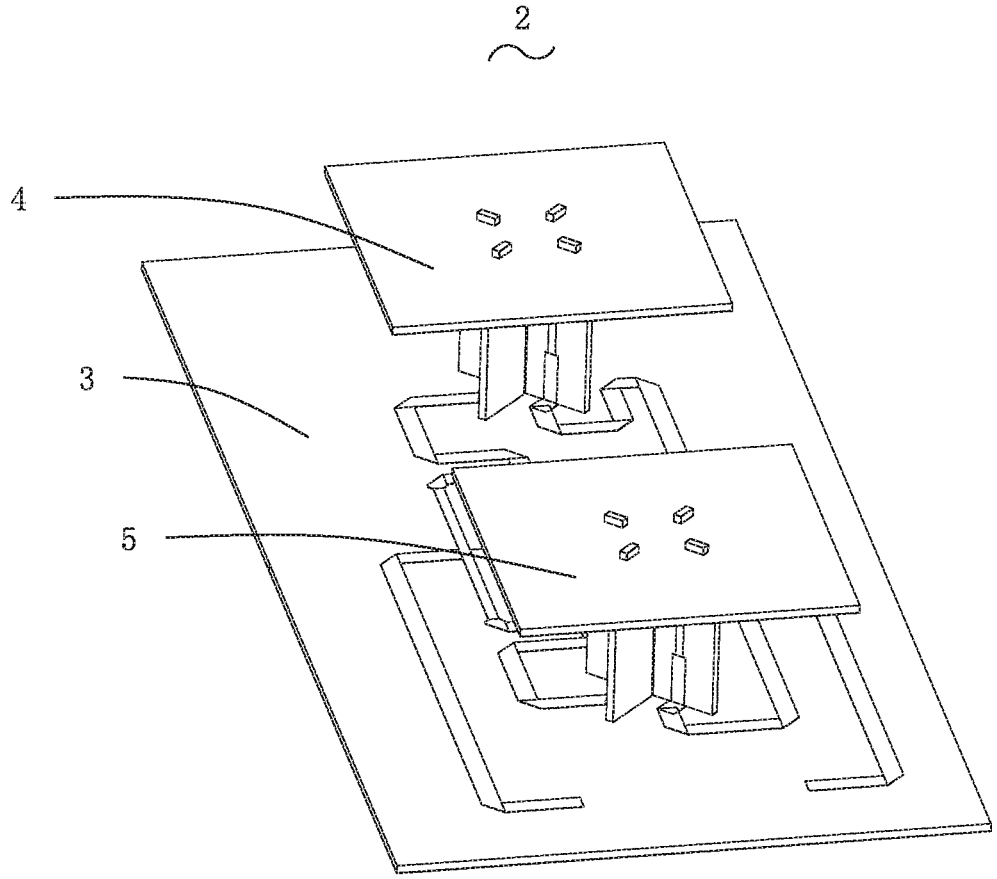
FIG. 2 is a schematic diagram of a three-dimensional structure of an antenna sub-array provided in an embodiment of the present disclosure.

Referring to FIG. 1 and FIG. 2, the present disclosure provides a base station antenna 1. The base station antenna 1 includes two antenna sub-arrays 2. Each of the antenna sub-arrays 2 includes a circuit board 3 and two antenna oscillators 4, 5, and the circuit board 3 may provide signals to the two antenna oscillators 4, 5. It may be understood that the base station antenna 1 may also include more than two antenna sub-arrays 2.

Figure 3:
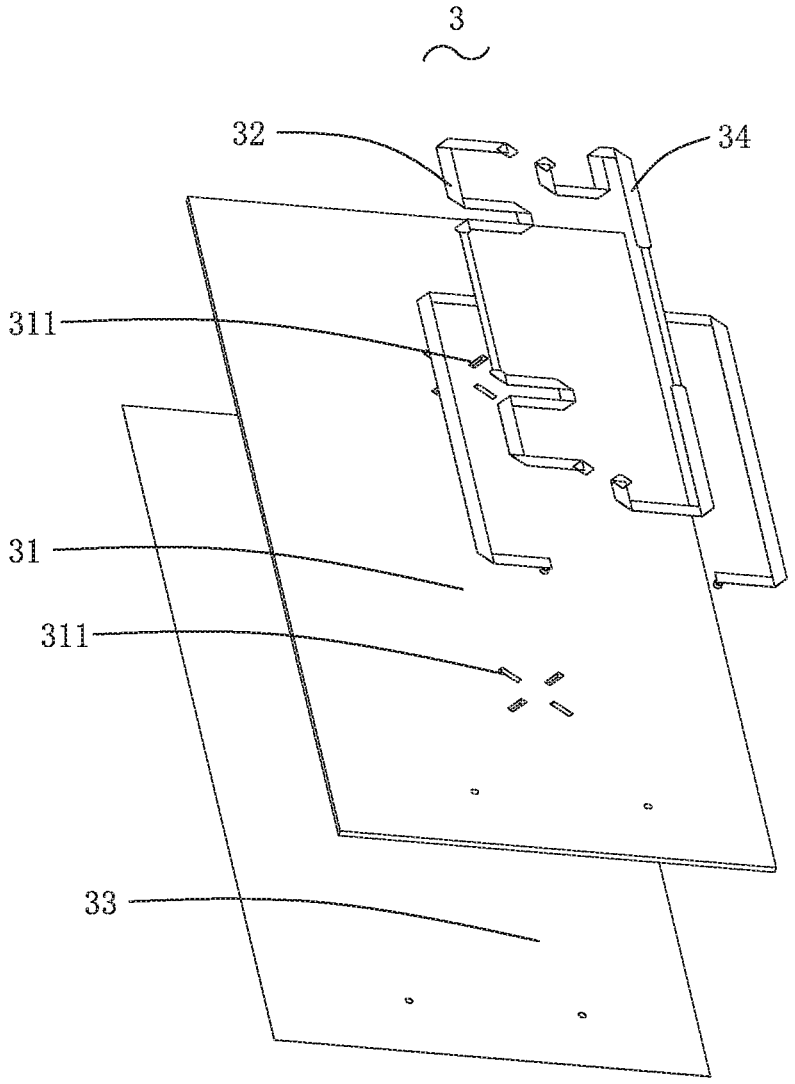
FIG. 3 is a schematic diagram of an exploded structure of a circuit board provided in an embodiment of the present disclosure.
Figure 4:
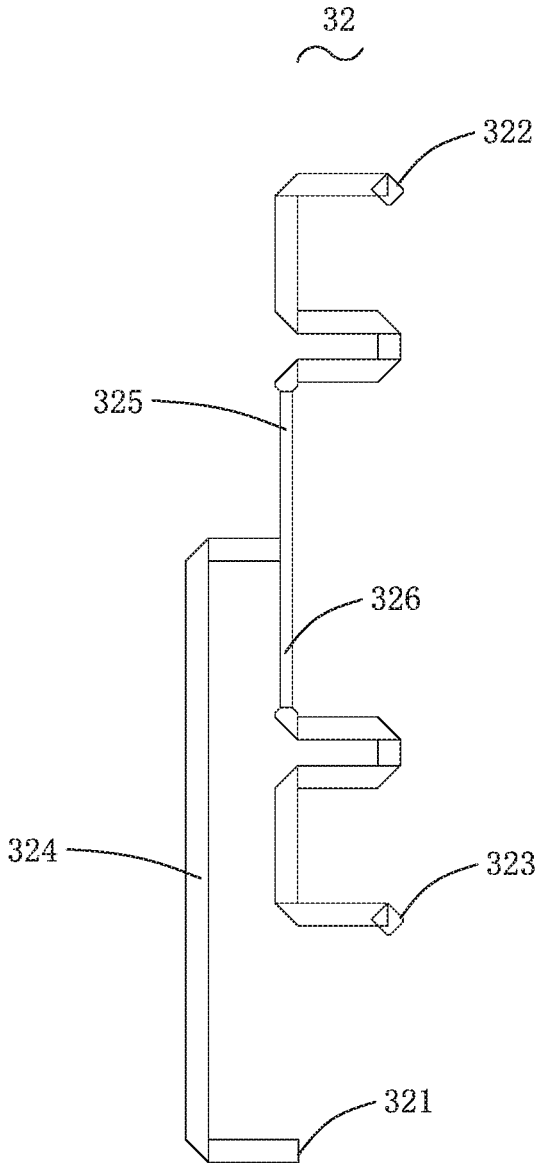
FIG. 4 is a schematic structural diagram of a first power divider provided in an embodiment of the present disclosure.

Referring to FIG. 3 and FIG. 4, the circuit board 3 includes a circuit substrate 31 and two power dividers disposed on a surface of the circuit substrate, namely, a first power divider 32 and a second power divider 34. Herein, the first power divider 32 and the second power divider 34 are disposed on the same surface of the circuit substrate 31. The first power divider 32 is electrically connected to the two antenna oscillators 4, 5 respectively, and the second power divider 34 is electrically connected to the two antenna oscillators 4, 5 respectively. The circuit board 3 further includes a ground plate 33 disposed on the surface of the circuit substrate 31 opposite to the first power divider 32 and the second power divider 34, and the ground plate 33 is electrically connected to the two antenna oscillators 4, 5 respectively. Thus, the two antenna sub-arrays 2 form a 4T4R transceiving mode. The ground plate 33, the first power divider 32 and the second power divider 34 may be formed on the circuit substrate 31 through a printed circuit board (PCB) process.

Both the first power divider 32 and the second power divider 34 are one-to-two power dividers, both the first power divider 32 and the second power divider 34 are used to divide a signal into two signals, and both the first power divider 32 and the second power divider 34 include a first end 321, a second end 322 and a third end 323. The first end 321 of the first power divider 32 is used to connect a radio frequency front end, the second end 322 of the first power divider 32 is electrically connected to a first antenna oscillator 4, and the third end 323 of the first power divider 32 is electrically connected to a second antenna oscillator 5. The first end 321 of the second power divider 34 is used to connect the radio frequency front end, the second end 322 of the second power divider 34 is electrically connected to the first antenna oscillator 4, the third end 323 of the second power divider 34 is electrically connected to the second antenna oscillator 5. Specifically, both the first power divider 32 and the second power divider 34 include a first connection line 324, a second connection line 325 and a third connection line 326. The second connection line 325 and the third connection line 326 are electrically connected to the first connection line 324 respectively, one end of the first connection line 324 away from the second connection line 325 is the first end 321, one end of the second connection line 325 away from the first connection line 324 is the second end 322, and one end of the third connection line 326 away from the first connection line 324 is the third end 323. A manner in which the first power divider 32 and the second power divider 34 are disposed on the circuit substrate 31 is not limited. For example, the first power divider 32 and the second power divider 34 may be electroplated on the circuit substrate 31, or disposed on the circuit substrate 31 by using Laser-Direct-structuring (LDS) process. The shapes of the first connection line 324, the second connection line 325 and the third connection line 326 are not limited, which may be bent and extended as required.

The shape of the circuit substrate 31 is not limited, which may be set as required. A connection hole 311 is provided on the circuit substrate 31, and the connection hole 311 is used to fix the antenna oscillators 4, 5 with the circuit substrate 31. In this embodiment, eight connection holes 311 are provided, and every four connection holes 311 are used to fix one antenna oscillator 4 or 5.

The ground plate 33 is used for grounding, and an avoiding hole (not shown in the figure) is provided on the ground plate 33. In this embodiment, eight avoiding holes are provided, every four avoiding holes are used for one antenna oscillator 4 or 5 to pass through.

Figure 5:
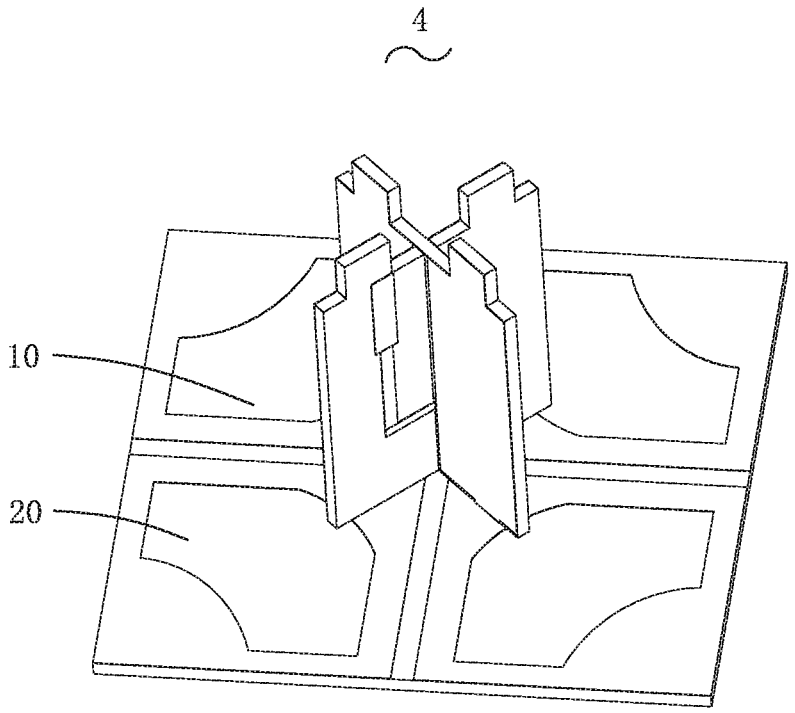
FIG. 5 is a schematic diagram of a three-dimensional structure of an antenna provided in an embodiment of the present disclosure.

Referring to FIG. 5, the antenna oscillators 4, 5 include a first oscillator unit 10 and a second oscillator unit 20 of which polarizations are orthogonal. Herein, the second end 322 of the first power divider 32 is electrically connected to the first oscillator unit 10 of the first antenna oscillator 4, the third end 323 of the first power divider 32 is electrically connected to the first oscillator unit 10 of the second antenna oscillator 5, the second end 322 of the second power divider 34 is electrically connected to the second oscillator unit 20 of the first antenna oscillator 4, and the third end 323 of the second power divider 34 is electrically connected to the second oscillator unit 20 of the second antenna oscillator 5.

Figure 6:
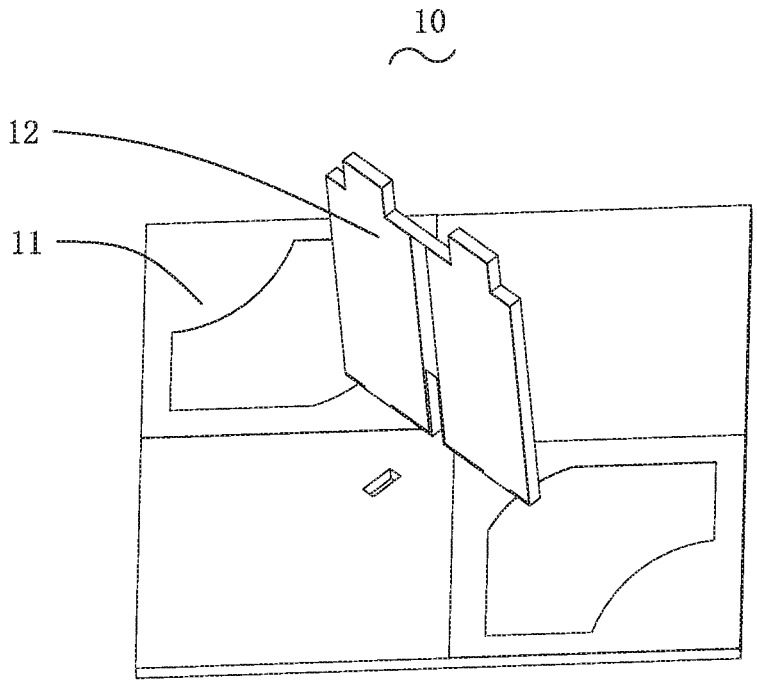
FIG. 6 is a schematic diagram of a three-dimensional structure of a first oscillator unit provided in an embodiment of the present disclosure.

Referring to FIG. 6, the first oscillator unit 10 includes a first radiating portion 11 and a first feeding portion 12 for feeding the first radiating portion 11, and the first radiating portion 11 is connected to the ground plate 33 of the circuit board 3 through the first feeding portion 12, that is, the first feeding portion 12 is located between the first radiating portion 11 and the circuit board 3.

Figure 7:
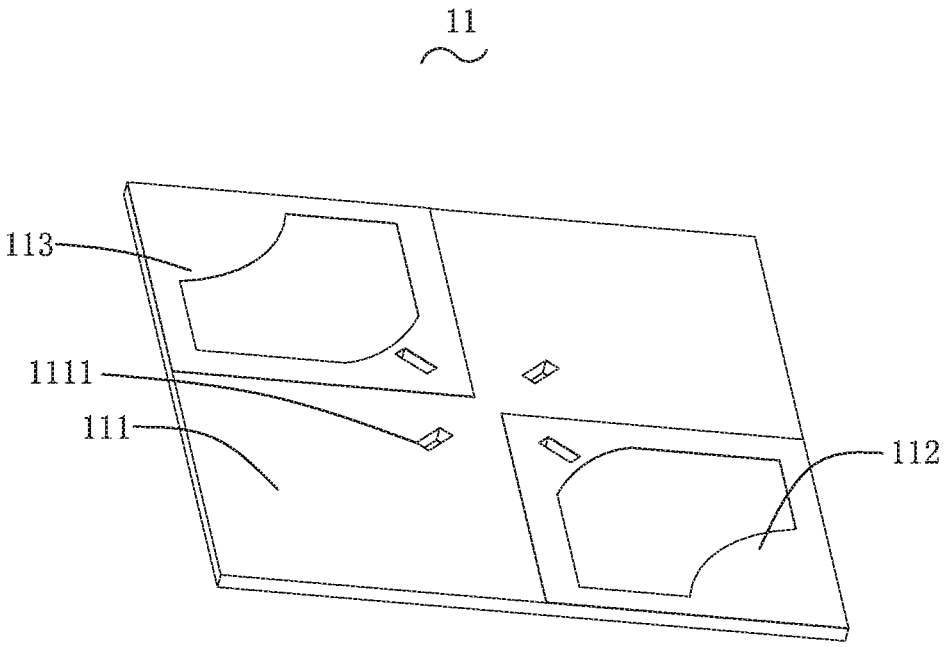
FIG. 7 is a schematic diagram of a three-dimensional structure of a first radiating portion provided in an embodiment of the present disclosure.

Referring to FIG. 7, the first radiating portion 11 includes a radiating substrate 111, and a first radiator 112 and a second radiator 113 that are disposed on the radiating substrate 111. The first radiator 112 and the second radiator 113 are disposed separately from and symmetrically with each other. Both the first radiator 112 and the second radiator 113 are disposed on a surface of the radiating substrate 111 adjacent to the circuit board 3. The radiating substrate 111, the first radiator 112 and the second radiator 113 are all connected to the first feeding portion 12. The first radiator 112 and the second radiator 113 may be formed on the radiating substrate 111 through the PCB process.

The shape of the radiating substrate 111 is not limited, which may be set as required. In this embodiment, the shape of the radiating substrate 111 is square. A fixing hole 1111 are provided on the radiating substrate 111. In this embodiment, four fixing holes 1111 are provided.

Figure 8:
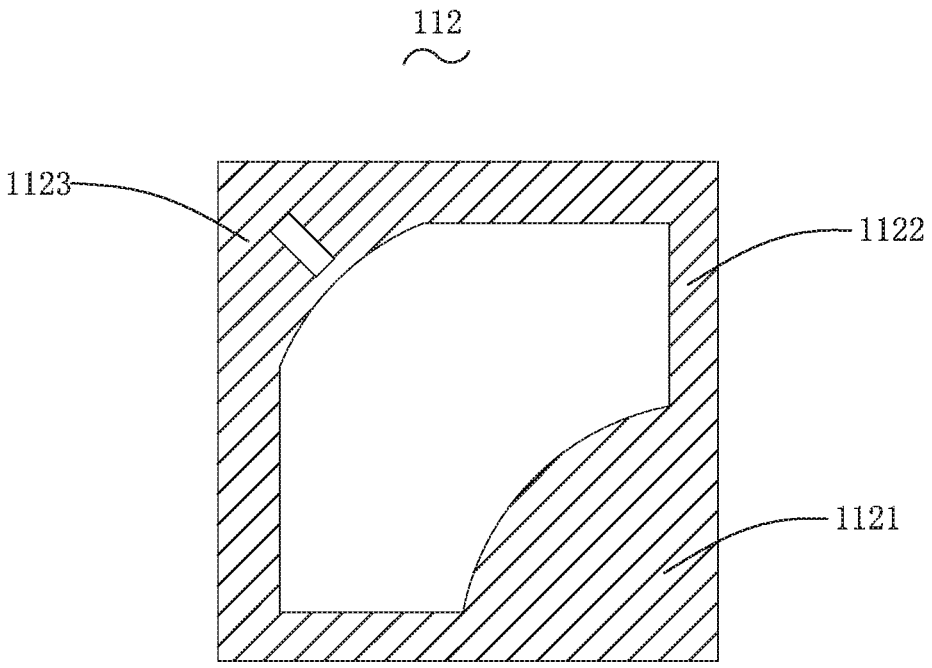
FIG. 8 is a schematic structural diagram of a first radiator provided in an embodiment of the present disclosure.

Referring to FIG. 8, the first radiator 112 may radiate electromagnetic waves. The first radiator 112 includes a sector portion 1121 with a central angle of 90°, two extension portions 1122 extending from two radii of the sector portion 1121 in a direction away from a center of the sector portion 1121, and an L-shaped connection portion 1123 connecting the two extension portions 1122. An outer contour of the first radiator 112 is square. A right angle in the middle of the L-shaped connection portion 1123 is adjacent to a center of the radiating substrate 111, that is, the center of the sector portion 1121 is away from the second radiator 113. It may be understood that the first radiator 112 may also become rectangular by adjusting a length of the extension portion 1122 and lengths of two sides of the L-shaped connection portion 1123. A structure of the first radiator 112 makes the radiation effect better.

The second radiator 113 has the same structure as the first radiator 112 and will not be described in this embodiment again. It should be noted that a right angle in the middle of the L-shaped connection portion of the second radiator 113 is adjacent to the center of the radiating substrate 111, that is, a center of the sector portion of the second radiator 113 is away from the first radiator 112.

Figure 9:
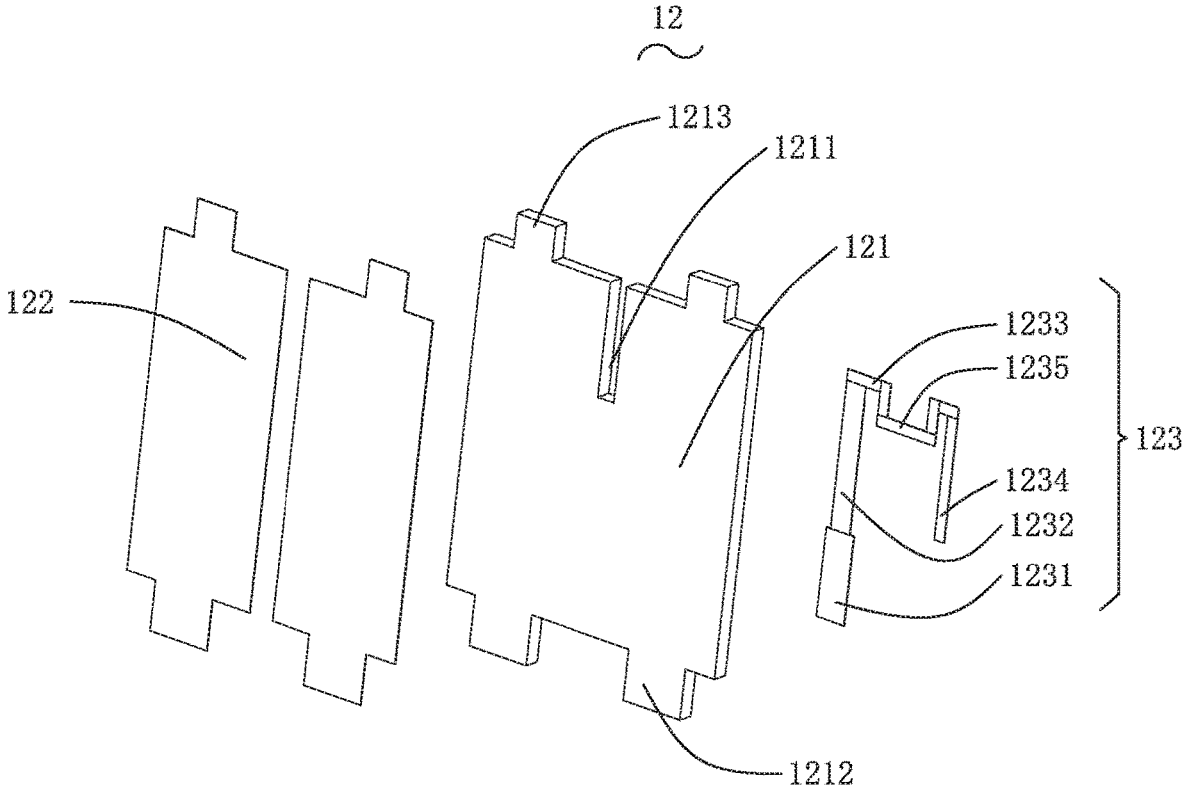
FIG. 9 is a schematic diagram of an exploded structure of a first feeding portion provided in an embodiment of the present disclosure.

Referring to FIG. 9, the first feeding portion 12 includes a first feeding substrate 121, and a first ground 122 and a first microstrip line 123 that are respectively disposed on both sides of the first feeding substrate 121. One end of the first feeding substrate 121 is perpendicular to and connected to the radiating substrate 111, the other end of the first feeding substrate 121 is perpendicular to and connected to the circuit substrate 31, the first ground 122 is electrically connected to the first radiator 112, the second radiator 113 and the ground plate 33 respectively, and the first microstrip line 123 is separated from and coupled to the first radiator 112 and the second radiator 113 respectively. The first ground 122 and the first microstrip line 123 may be formed on the first feeding substrate 121 through the PCB process.

A short slot 1211 is provided on the first feeding substrate 121 to be engaged with the second oscillator unit 20. A first protrusion 1212 is provided on one end of the first feeding substrate 121 connected to the circuit substrate 31. The first protrusion 1212 may be inserted into the connection hole 311 of the circuit substrate 31 to be engaged with the circuit substrate 31. In this embodiment, two first protrusions 1212 are provided. A second protrusion 1213 is provided on one end of the first feeding substrate 121 connected to the radiating substrate 111, and the second protrusion 1213 may be inserted into the fixing hole 1111 of the radiating substrate 111 to be engaged with the radiating substrate 111. In this embodiment, two second protrusions 1213 are provided.

The first ground 122 is electrically connected to the first radiator 112 and the second radiator 113 respectively. In this embodiment, two first grounds 122 are provided, and the two first grounds 122 are located on both side portions of a surface where the two first grounds 122 are provided. One first ground 122 is electrically connected to the first radiator 112 and the ground plate 33 of the circuit board 3 respectively, and the other first ground 122 is electrically connected to the second radiator 113 and the ground plate 33 of the circuit board 3. It may be understood that only one first ground 122 may be provided, and the first ground 122 may be electrically connected to the first radiator 112, the second radiator 113 and the ground plate 33 respectively.

The first microstrip line 123 includes a first feeding port 1231 disposed on one end of the first feeding substrate 121 away from the radiating substrate 111, a first strip line 1232 extending from the first feeding port 1231 in a direction adjacent to the radiating substrate 111, a second strip line 1233 extending from one end of the first strip line 1232 away from the first feeding port 1231 in a direction parallel to the radiating substrate 111, and a third strip line 1234 extending from one end of the second strip line 1233 away from the first strip line 1232 in a direction away from the radiating substrate 111. In this embodiment, the second strip line 1233 further includes a avoiding portion 1235, so that the second strip line 1233 does not intersect with a fifth strip line. It may be understood that a structure of the first microstrip line 123 is not limited to the structure described above, as long as it may transmit signals.

Herein, the first feeding port 1231 of the first microstrip line 123 of the first antenna oscillator 4 is electrically connected to the second end 322 of the first power divider 32, and the first microstrip line 123 of the second antenna oscillator 5 is electrically connected to the third end 323 of the first power divider 32. The first microstrip line 123 also radiates signals while being coupled with the first radiator 112 and the second radiator 113 respectively, which expands a bandwidth of the radiation.

Figure 10:
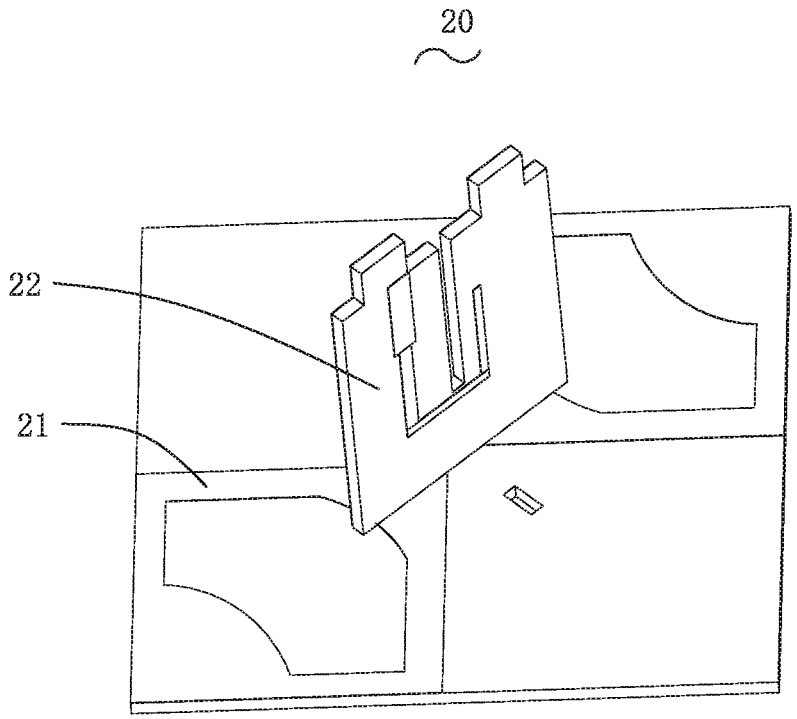
FIG. 10 is a schematic diagram of a three-dimensional structure of a second oscillator unit provided in an embodiment of the present disclosure.

Referring to FIG. 10, the second oscillator unit 20 includes a second radiating portion 21 and a second feeding portion 22 for feeding the second radiating portion 21. The second radiating portion 21 is connected to the circuit board 3 through the second feeding portion 22, that is, the second feeding portion 22 is located between the second radiating portion 21 and the circuit board 3.

Figure 11:
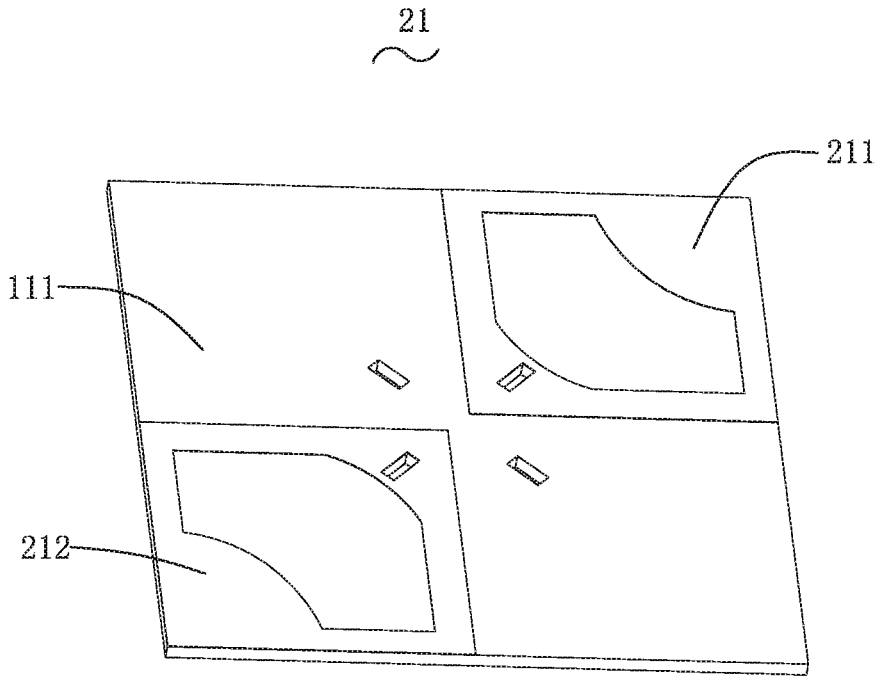
FIG. 11 is a schematic diagram of a three-dimensional structure of a second radiating portion provided in an embodiment of the present disclosure.

Referring to FIG. 11, the second radiating portion 21 includes the radiating substrate 111 shared with the first radiating portion 11, and a third radiator 211 and a fourth radiator 212 that are disposed on the radiating substrate 111. The third radiator 211 and the fourth radiator 212 are disposed separately from and symmetrically with each other. Both the third radiator 211 and the fourth radiator 212 are disposed on a surface of the radiating substrate 111 adjacent to the circuit board 3, that is, the first radiator 112, the second radiator 113, the third radiator 211 and the fourth radiator 212 are located on the same surface of the radiating substrate 111. The radiating substrate 111, the third radiator 211 and the fourth radiator 212 are all connected to the second feeding portion 22. The third radiator 211 and the fourth radiator 212 may be formed on the radiating substrate 111 through the PCB process.

The third radiator 211 has the same structure as the first radiator 112 and will not be described in this embodiment again. It should be noted that a right angle in the middle of the L-shaped connection portion of the third radiator 211 is adjacent to the center of the radiating substrate 111, that is, a center of the sector portion of the third radiator 211 is away from the fourth radiator 212.

The fourth radiator 212 has the same structure as the first radiator 112 and will not be described in this embodiment again. It should be noted that a right angle in the middle of the L-shaped connection portion of the fourth radiator 212 is adjacent to the center of the radiating substrate 111, that is, a center of the sector portion of the fourth radiator 212 is away from the third radiator 211. A straight line where a geometric center of the first radiator 112 and a geometric center of the second radiator 113 are located is perpendicular to a straight line where a geometric center of the third radiator 211 and a geometric center of the fourth radiator 212 are located.

In this embodiment, the first radiator 112, the second radiator 113, the third radiator 211 and the fourth radiator 212 form a square. The first radiator 112, the second radiator 113, the third radiator 211 and the fourth radiators 212 are respectively located at four corners of the square. Specifically, circles of four sector portions of the first radiator 112, the second radiator 113, the third radiator 211 and the fourth radiator 212 are respectively located at the four corners of the square.

Figure 12:
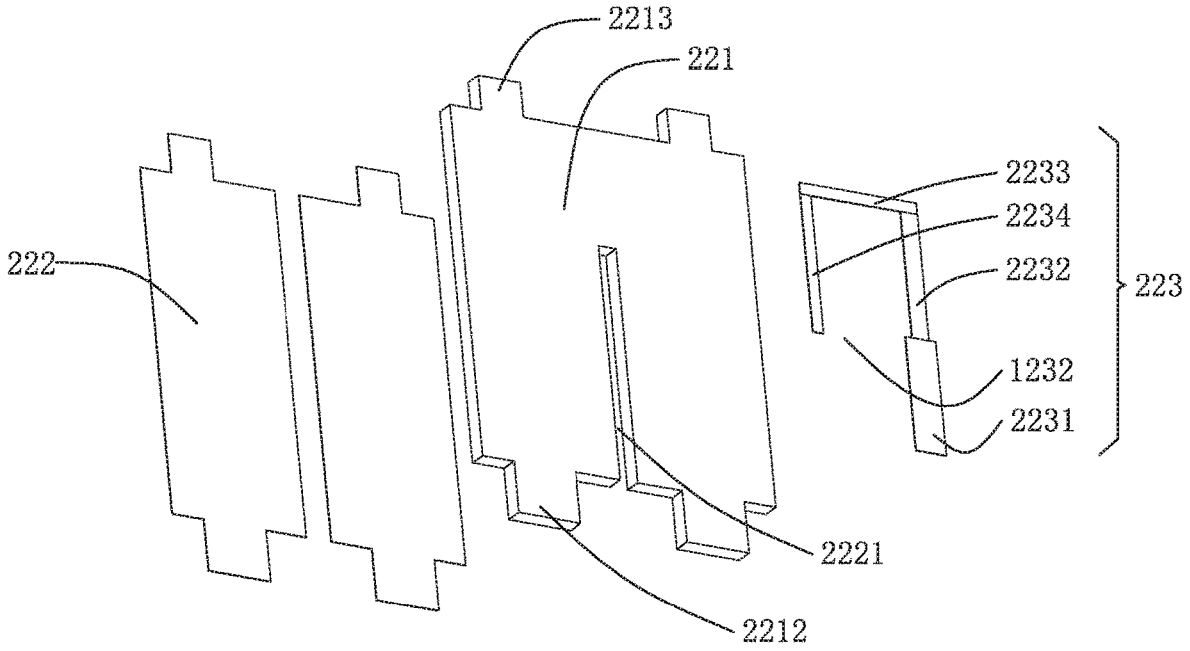
FIG. 12 is a schematic diagram of an exploded structure of a second feeding portion provided in an embodiment of the present disclosure.

Referring to FIG. 12, the second feeding portion 22 includes a second feeding substrate 221, and a second ground 222 and a second microstrip line 223 that are respectively disposed on both sides of the second feeding substrate 221. One end of the second feeding substrate 221 is perpendicular to and connected to the radiating substrate 111, and the other end of the second feeding substrate 221 is perpendicular to and connected to the circuit substrate 31. The second ground 222 is electrically connected to the third radiator 211, the fourth radiator 212 and the ground plate 33 respectively, and the second microstrip line 223 is separated from and coupled to the third radiator 211 and the fourth radiator 212 respectively. The second ground 222 and the second microstrip line 223 may be formed on the second feeding substrate 221 through the PCB process.

A long slot 2211 is provided on the second feeding substrate 221 to be engaged with the short slot 1211 of the first feeding substrate 121 of the first oscillator unit 10. The long slot 2211 is engaged with the short slot 1211, so that the first oscillator unit 10 and the second oscillator unit 20 form an orthogonal engaging connection structure. It should be noted that the orthogonal engaging connection manner in which the long slot 1211 is provided on the first feeding substrate 121 and the short slot 2211 is provided on the second feeding substrate 221 is only an example for description. Other forms of engaging connection structures may also be set according to the structural characteristics of the first feeding substrate 121 and the second feeding substrate 221, which are not specifically limited here. A third protrusion 2212 is provided on one end of the second feeding substrate 221 connected to the circuit substrate 31. The third protrusion 2212 may be inserted into the connection hole 311 of the circuit substrate 31 to engaged with the circuit substrate 31. In this embodiment, two third protrusions 2212 are provided. A fourth protrusion 2213 are provided on one end of the second feeding substrate 221 connected to the radiating substrate 111. The fourth protrusion 2213 may be inserted into the radiating substrate 111 to be engaged with the radiating substrate 111. In this embodiment, two fourth protrusions 2213 are provided.

The second ground 222 is electrically connected to the third radiator 211 and the fourth radiator 212 respectively. In this embodiment, two second grounds 222 are provided, and the two second grounds 222 are located on both side portions of a surface where the two second grounds 222 are disposed. One second ground 222 is electrically connected to the third radiator 211 and the ground plate 33 of the circuit board 3 respectively, and the other second ground 222 is electrically connected to the fourth radiator 212 and the ground plate 33 of the circuit board 3. It may be understood that only one second ground 222 may be provided, and the second ground 222 may be electrically connected to the third radiator 211, the fourth radiator 212 and the ground plate 33 respectively.

The second microstrip line 223 includes a second feeding port 2231 disposed on one end of the second feeding substrate 221 away from the radiating substrate 111, a fourth strip line 2232 extending from the second feeding port 2231 in a direction adjacent to the radiating substrate 111, a fifth strip line 2233 extending from one end of the fourth strip line 2232 adjacent to the radiating substrate 111 in a direction parallel to the radiating substrate 111, and a sixth strip line 2234 extending from one end of the fifth strip line 2233 away from the fourth strip line 2232 in a direction away from the radiating substrate 111. It may be understood that a structure of the second microstrip line 223 is not limited to the structure described above, as long as it may transmit signals.

Herein, the second feeding port 2231 of the second microstrip line 223 of the first antenna oscillator 4 is electrically connected to the second end 322 of the second power divider 34, and the second microstrip line 223 of the second antenna oscillator 5 is electrically connected to the third end 323 of the second power divider 34. The second microstrip line 223 also radiates signals while being respectively coupled to the third radiator 211 and the fourth radiator 212, which expands the bandwidth of the radiation.

Figure 13:
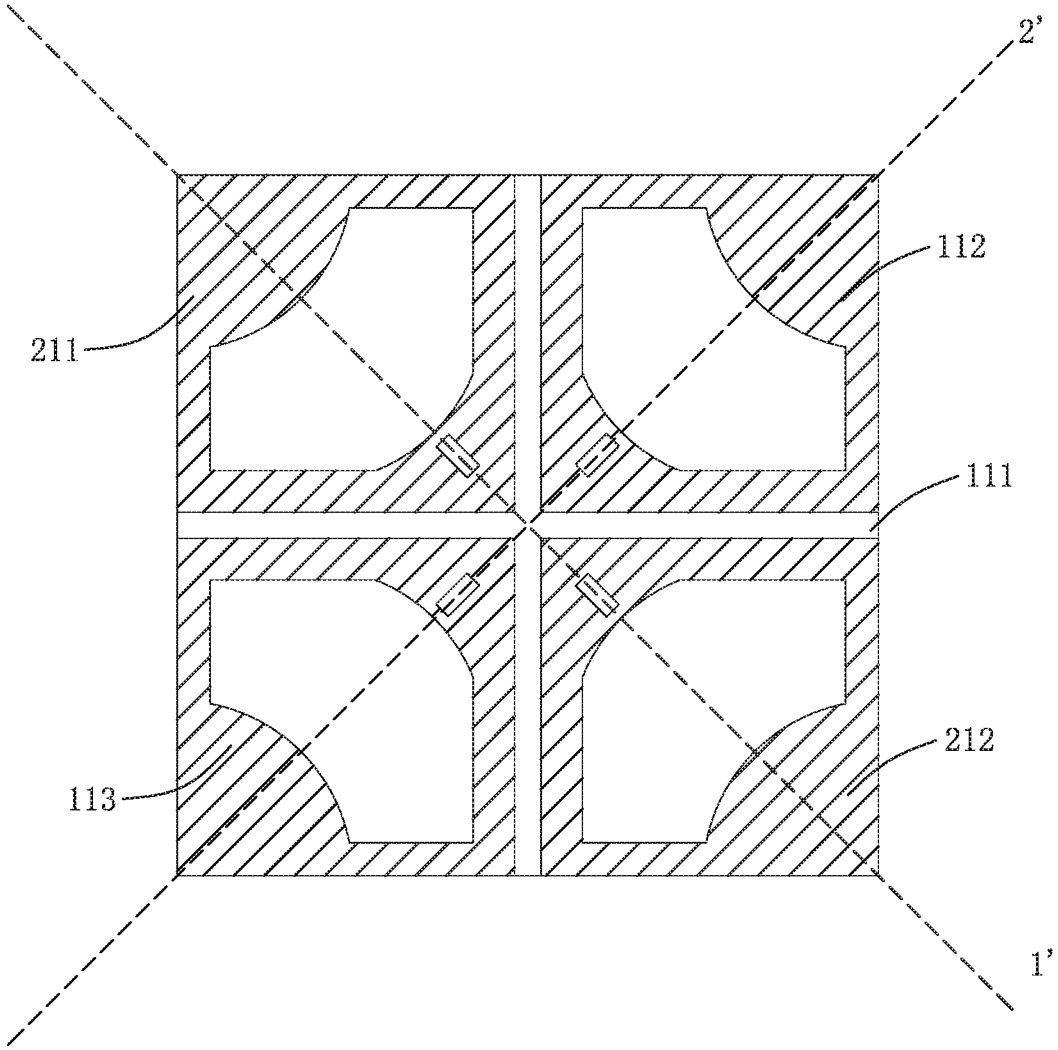
FIG. 13 is a schematic structural diagram of the first radiating portion and the second radiating portion provided in an embodiment of the present disclosure.

Referring to FIG. 13, the first radiator 112 and the second radiator 113 of the first oscillator unit 10 are symmetrical to each other about a first symmetry line 1', and the third radiator 211 and the fourth radiator of the second oscillator unit 20 are symmetrical to each other about a second symmetry line 2'. The first symmetry line 1' is perpendicular to the second symmetry line 2', and the first radiator 112 and the second radiator 113 of the first oscillator unit 10 is axisymmetric about the second symmetry line 2', and the third radiator 211 and the fourth radiator 212 of the second oscillator unit 20 is axisymmetric about the first symmetry line 1'. An intersection of the first symmetry line 1' and the second symmetry line 2' is a center point O. The center point O corresponds to the center of the radiating substrate 111.

In specific implementation, an orthographic projection of the first feeding substrate 121 of the first oscillator unit 10 on the radiating substrate 111 is pressed against the second symmetry line 2', that is, the orthographic projection of the first feeding substrate 121 on the radiating substrate 111 is located on the straight line where the geometric center of the first radiator 112 and the geometric center of the second radiator 113 are located. An orthographic projection of the second feeding substrate 221 of the second oscillator unit 20 on the radiating substrate 111 is pressed against the first symmetry line 1', that is, the orthographic projection of the second feeding substrate 221 on the radiating substrate 111 is located on the straight line where the geometric center of the third radiator 211 and the geometric center of the fourth radiator 212 are located. A polarization of the first oscillator unit 10 is orthogonal to a polarization of the second oscillator unit 20. For example, the first oscillator unit 10 and the second oscillator unit 20 adopt a ±45° orthogonal polarization mode to ensure better isolation.

Figure 14:
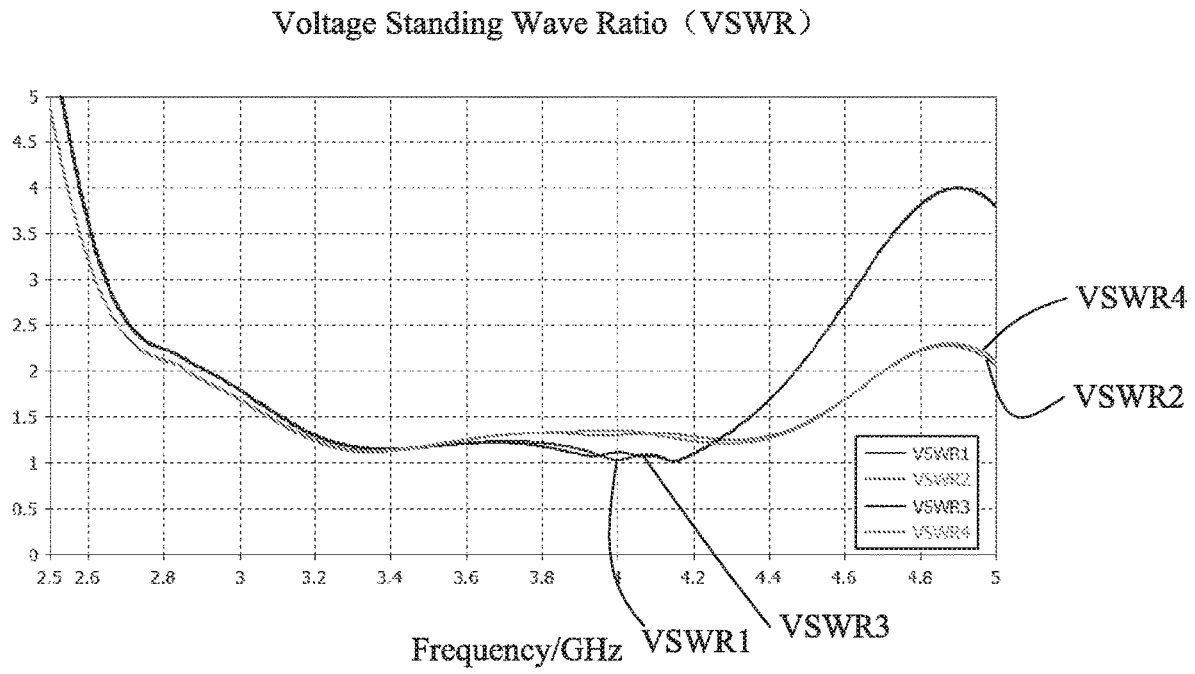
FIG. 14 is a schematic diagram of a relationship between a voltage standing wave ratio and a frequency of the base station antenna provided in an embodiment of the present disclosure.

The performance of the base station antenna 1 described above is shown in FIG. 14. It may be seen from the figure that the base station antenna 1 may cover 3.3~4.2 GHz frequency band and has a relatively high gain. By changing the size of the antenna oscillators 4, 5 of the base station antenna 1, the base station antenna 1 may also be applied to other frequency bands, such as 2.5 GHz or 4.9 GHz.

It should be noted that the above are only examples and do not limit the technical solutions of the present disclosure.

The above are only embodiments of the present disclosure, and it should be noted that those of ordinary skills in the art may also make improvements without departing from the inventive concepts of the present disclosure, however, these improvements all belong to the protection scope of the present disclosure.

What is claimed is:

1. A base station antenna, wherein the base station antenna comprises at least two antenna sub-arrays, each of the antenna sub-arrays comprises a circuit board and two antenna oscillators; the circuit board comprises a circuit substrate, and a first power divider and a second power divider that are disposed on a surface of the circuit substrate; the first power divider and the second power divider are respectively used to divide one signal into two signals, and the first power divider and the second power divider comprise a first end, a second end and a third end; each of the antenna oscillators comprises two pairs of first oscillator units and second oscillator units of which polarizations are orthogonal; the first end of the first power divider is used to connect a radio frequency front end, the second end of the first power divider is electrically connected to the first oscillator unit of a first antenna oscillator, and the third end of the first power divider is electrically connected to the first oscillator unit of a second antenna oscillator; the first end of the second power divider is used to connect the radio frequency front end, the second end of the second power divider is electrically connected to the second oscillator unit of the first antenna oscillator, and the third end of the second power divider is electrically connected to the second oscillator unit of the second antenna oscillator; and two antenna sub-arrays form a 4T4R transceiving mode.

2. The base station antenna according to claim 1, wherein the first power divider and the second power divider comprise a first connection line, a second connection line and a third connection line; the second connection line and the third connection line are electrically connected to the first connection line respectively; one end of the first connection line away from the second connection line is a first end, one end of the second connection line away from the first connection line is a second end, and one end of the third connection line away from the first connection line is a third end.

3. The base station antenna according to claim 1, wherein the first power divider and the second power divider are disposed on the same surface of the circuit substrate; the circuit board further comprises a ground plate disposed on a surface of the circuit substrate opposite to the first power divider, and the ground plate is electrically connected to the first oscillator unit and the second oscillator unit of each of the antenna oscillators respectively.

4. The base station antenna according to claim 1, wherein the first oscillator unit comprises a first radiating portion; the first radiating portion comprises a radiating substrate, and a first radiator and a second radiator that are disposed on a surface of the radiating substrate, and the first radiator and the second radiator are disposed separately from and symmetrically with each other; and the second oscillator unit comprises a second radiating portion; the second radiating portion comprises the radiating substrate shared with the first radiating portion, and a third radiator and a fourth radiator that are disposed on the surface of the radiating substrate; the third radiator and the fourth radiator are disposed separately from and symmetrically with each other; a straight line where a geometric center of the first radiator and a geometric center of the second radiator are located is perpendicular to a straight line where a geometric center of the third radiator and a geometric center of the fourth radiator are located.

5. The base station antenna according to claim 4, wherein the first radiator, the second radiator, the third radiator and the fourth radiator have the same structure and comprise a sector portion with a central angle of 90°, two extension portions extending from two radii of the sector portion in a direction away from a center of the sector portion, and an L-shaped connection portion connecting the two extension portions; and an outer contour of the radiators is square.

6. The base station antenna according to claim 5, wherein a corner of the L-shaped connection portion is adjacent to a center of the radiating substrate; the first radiator, the second radiator, the third radiator and the fourth radiator form a square; the first radiator, the second radiator, the third radiator and the fourth radiator are respectively located at four corners of the square; and circles of four sector portions of the first radiator, the second radiator, the third radiator and the fourth radiator are respectively located at the four corners of the square.

7. The base station antenna according to claim 5, wherein an inner corner of the L-shaped connection portion is a smooth transition.

8. The antenna according to claim 4, wherein:

the first oscillator unit further comprises a first feeding portion for feeding the first radiating portion;

the first feeding portion comprises a first feeding substrate, a first ground disposed on one side surface of the first feeding substrate, and a first microstrip line disposed on the other side surface of the first feeding substrate; the first microstrip line of the first antenna oscillator is electrically connected to the second end of the first power divider, and the first microstrip line of the second antenna oscillator is electrically connected to the third end of the first power divider;

one end of the first feeding substrate is perpendicular to and connected to the radiating substrate, and the other end of the first feeding substrate is perpendicular to and connected to the circuit substrate; the first ground is connected to the first radiator and the second radiator respectively, and the first microstrip line is separated from and coupled to the first radiator and the second radiator respectively;

the second oscillator unit further comprises a second feeding portion for feeding the second radiating portion;

the second feeding portion comprises a second feeding substrate, a second ground disposed on one side surface of the second feeding substrate, and a second microstrip line disposed on the other side surface of the second feeding substrate; the second microstrip line of the first antenna oscillator is electrically connected to the second end of the second power divider, and the second microstrip line of the second antenna oscillator is electrically connected to the third end of the second power divider; and one end of the second feeding substrate is perpendicular to and connected to the radiating substrate, and the other end of the second feeding substrate is perpendicular to and connected to the circuit substrate; the second ground is connected to the third radiator and the fourth radiator, and the second microstrip line is separated from and coupled to the third radiator and the fourth radiator respectively.

9. The base station antenna according to claim 8, wherein the first radiator, the second radiator, the third radiator and the fourth radiator are located on the same surface of the radiating substrate; and the first radiator and the second radiator are symmetrical to each other about a first symmetry line, and the third radiator and the fourth radiator are symmetrical to each other about a second symmetry line; the first symmetry line is perpendicular to the second symmetry line, each radiator of the first oscillator unit is axisymmetric about the second symmetry line, and each radiator of the second oscillator unit is axisymmetric about the first symmetry line.

10. The base station antenna according to claim 8, wherein the first feeding substrate is respectively engaged with the radiating substrate and the circuit substrate, and the second feeding substrate is respectively engaged with the radiating substrate and the circuit substrate.

* * * * *